US008920177B1

(12) United States Patent
Hsiao

(10) Patent No.: US 8,920,177 B1
(45) Date of Patent: Dec. 30, 2014

(54) ROTATING ELECTRICAL PLUG

(71) Applicant: Serene House International Enterprise Ltd., Road Town (VG)

(72) Inventor: Ming Jen Hsiao, Miaoli County (TW)

(73) Assignee: Serene House International Enterprise Ltd., Tortola (VG)

( * ) Notice: Subject to any disclaimer, the term of this patent is extended or adjusted under 35 U.S.C. 154(b) by 15 days.

(21) Appl. No.: 13/927,308

(22) Filed: Jun. 26, 2013

(51) Int. Cl.
*H01R 39/00* (2006.01)

(52) U.S. Cl.
USPC ..... 439/13; 439/21

(58) Field of Classification Search
USPC ..... 439/11, 13, 21, 640
See application file for complete search history.

(56) References Cited

U.S. PATENT DOCUMENTS

| | | | | |
|---|---|---|---|---|
| 6,843,656 | B2 * | 1/2005 | Hwang et al. | 439/11 |
| 7,712,915 | B2 * | 5/2010 | Liu | 362/183 |
| 8,066,420 | B2 | 11/2011 | Hsiao | |
| 8,123,528 | B2 * | 2/2012 | Devlin et al. | 439/21 |
| 8,133,059 | B1 | 3/2012 | Hsiao | |
| 8,147,097 | B1 * | 4/2012 | Hsiao | 362/288 |
| 8,147,116 | B1 | 4/2012 | Hsiao | |
| 8,262,277 | B2 | 9/2012 | Hsiao | |

* cited by examiner

*Primary Examiner* — Hien Vu
(74) *Attorney, Agent, or Firm* — Ming Chow; Sinorica, LLC

(57) ABSTRACT

A rotating electrical plug includes a hollow shell, a bottom cap attached to one side of the hollow shell, a rotary member detachably inserted into an opposite side of the hollow shell to selectively force respective locating notches thereof into engagement with locating blocks in the rotary member, an electrode holder coupled to the rotary member to hold electrodes in the hollow shell, an elastic member mounted in a sleeve of the electrode holder, and a fastening device affixed to the end cap to hold down the elastic member. Thus, the rotating electrical plug has a simple structure, and allows adjustment of the installation angle positively and safely to fit different electrical sockets.

12 Claims, 7 Drawing Sheets

ROTATING ELECTRICAL PLUG

BACKGROUND OF THE INVENTION

1. Field of the Invention

This invention relates to electrical plug technology, and more particularly to a rotating electrical plug, which has a simple structure and allows adjustment of the installation angle positively and safely to fit different electrical sockets.

2. Description of the Related Art

According to conventional electrical plug designs, the angular position between the metal conducting plates and the electrodes are not adjustable to fit different electrical outlets having plug holes configured in different directions.

Angle adjustable electrical plugs and night lamp systems are commercially available. Exemplars are seen in U.S. Pat. No. 8,066,420, entitled "Aroma diffusing night lamp system having an angle-adjustable electric plug"; U.S. Pat. No. 8,133,059, entitled "Angle-adjustable night lamp assembly for aroma diffusing night lamp system"; U.S. Pat. No. 8,147,097, entitled "Angle-adjustable aroma-diffusing night lamp system"; U.S. Pat. No. 8,147,116, entitled "Safety lamp bulb connector assembly"; U.S. Pat. No. 8,262,277, entitled "Aroma diffusing night lamp system with an angle-adjustable electric plug".

The aforesaid prior art designs allow adjustment of the angular position of the electrical plugs. However, according to the aforesaid prior art designs, the electrical plugs may be not accurately adjusted to the desired angular position after an adjustment, and the user may not be aware of the situation. Even if the electrical plugs are accurately adjusted to the desired angular position, the electrical plugs can be moved out of the adjusted angular position easily and accidentally, causing falling of the loaded essential oil or aromatic fluid. Further, during adjustment of the angular position of the electrical plugs, the user may be unable to make sure that the adjustment has already been accurately done.

Further, during adjustment of the angular position of the electrical plugs of the aforesaid prior art designs, the user cannot visually check the adjustment or sense the adjustment auditorally or tactilly, and adjustment errors can occur easily, leading to a safety problem.

SUMMARY OF THE INVENTION

The present invention has been accomplished under the circumstances in view. It is therefore the main object of the present invention to provide a rotating electrical plug, which has a simple structure and allows adjustment of the installation angle positively and safely to fit different electrical sockets.

It is another object of the present invention to provide a rotating electrical plug, which enables the user to sense the positioning between the hollow shell and the rotary member auditorally and tactilly when changing the installation angle of the rotating electrical plug.

To achieve this and other objects of the present invention, a rotating electrical plug of the present invention comprises a bottom cap having a shaft perpendicularly extended from one side thereof and terminating in a free end, a hollow shell connected to the bottom cap to surround the shaft and having at least one locating block located at an inner wall thereof, a rotary member, which comprises an open chamber defined in one side thereof, an stop flange radially extending around the periphery thereof, an annular plug flange perpendicularly and axially extended from one side of the stop flange and terminating in a sliding end edge and inserted into the inside of the hollow shell to couple the first shaft hole to the shaft and to have the stop flange be stopped against the hollow shell, a plurality of locating notches located on the sliding end edge for coupling to the locating blocks, a bottom wall transversely defined inside the annular plug flange and a first shaft hole defined in the bottom wall, an electrically insulative electrode holder, which comprises a center hole and a shaft sleeve perpendicularly extended from one side thereof around one end of the center hole and defining therein an axially extending second shaft hole and a transversely extending inside annular flange in the second shaft hole, an electrode holder mounted in the open chamber of the rotary member for enabling the shaft to be received in the second shaft hole inside the shaft sleeve, a metal elastic member mounted in the shaft sleeve around the shaft and stopped with one end thereof against the inside annular flange of the shaft sleeve, and a fastening device fastened to the free end of the shaft to secure an opposite end of the elastic member to the shaft.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
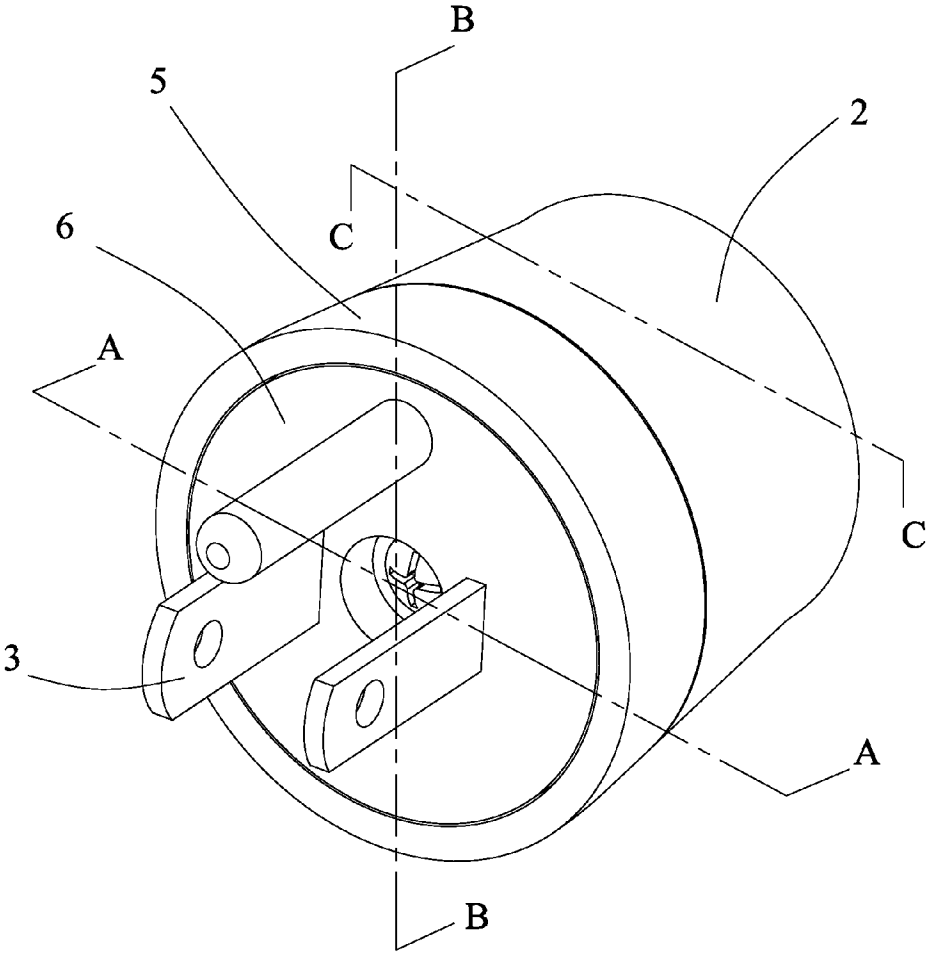
FIG. 1 is an elevational view of a rotating electrical plug in accordance with the present invention.
Figure 2:
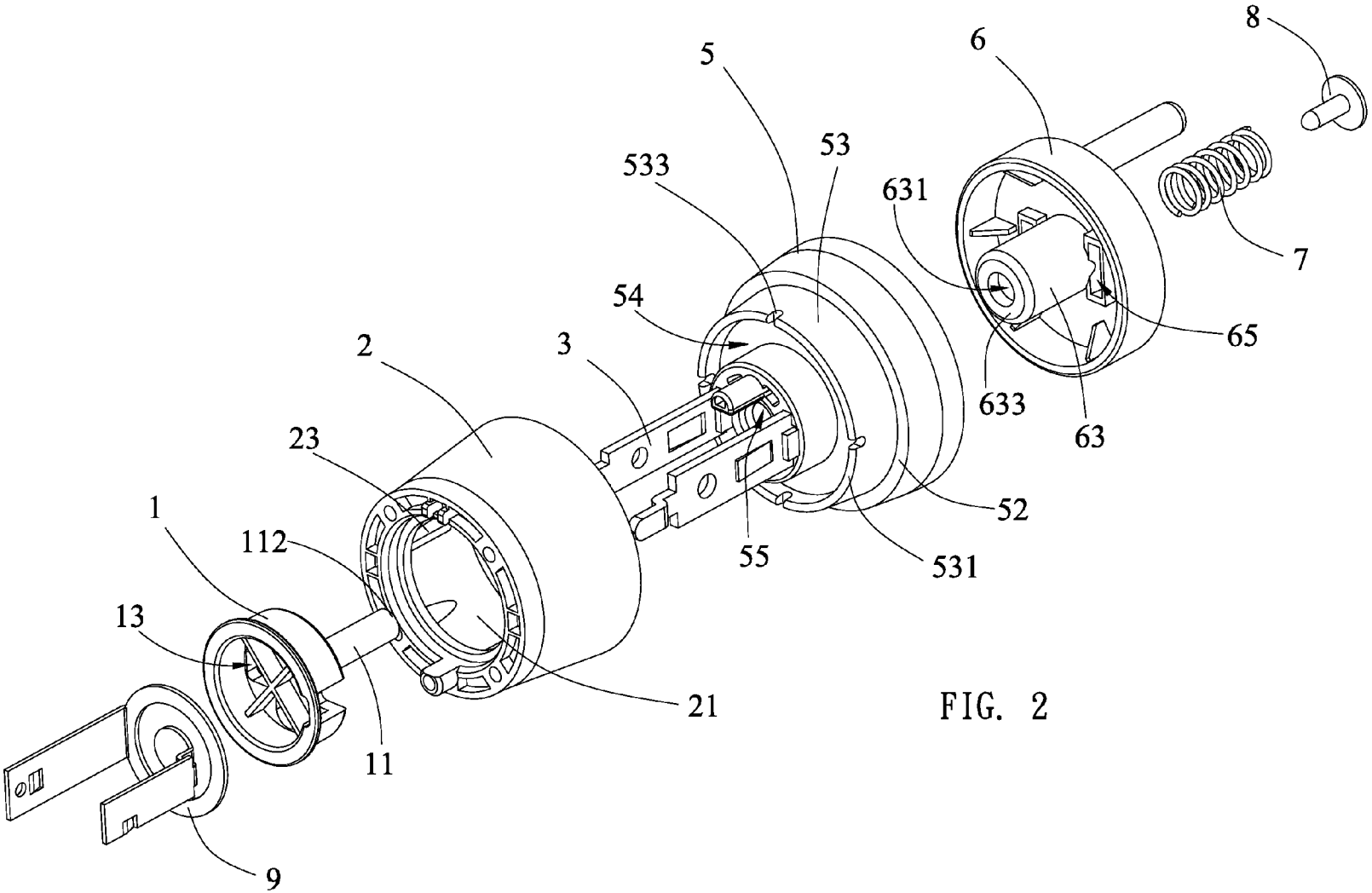
FIG. 2 is an exploded view of the rotating electrical plug in accordance with the present invention.
Figure 3:
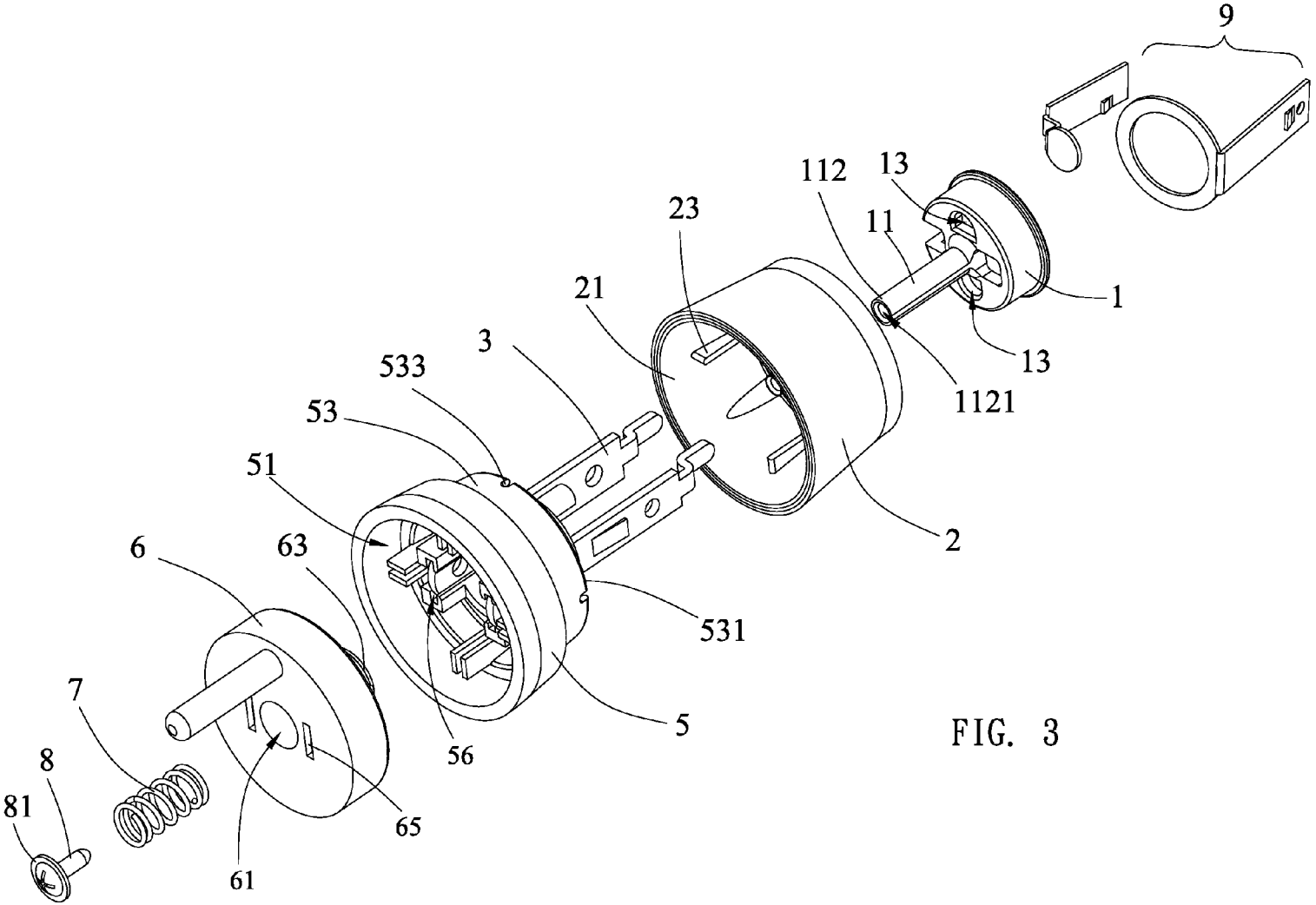
FIG. 3 corresponds to FIG. 2 when viewed from another angle.
Figure 4:
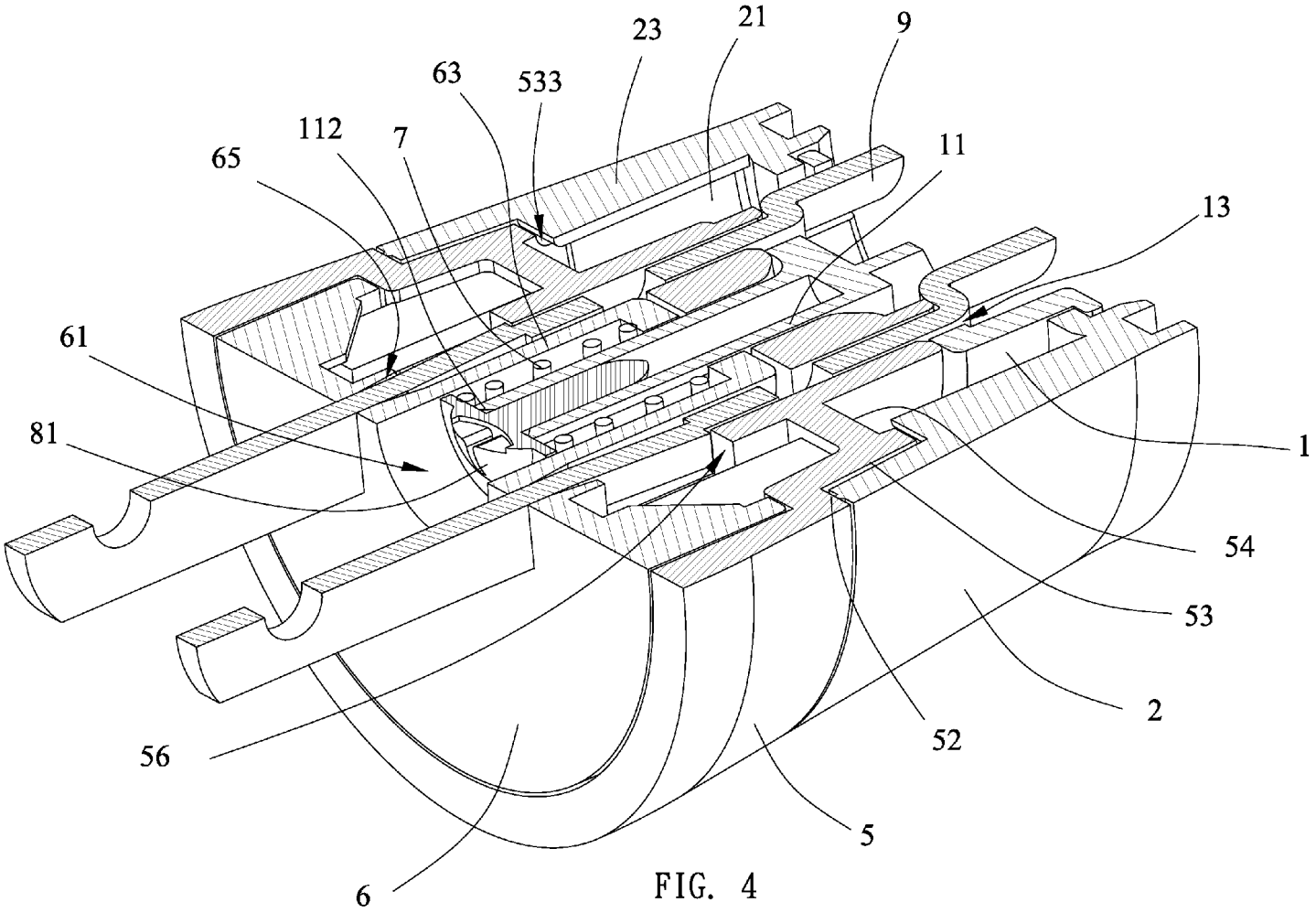
FIG. 4 is a sectional view, in an enlarged scale, taken along line A-A of FIG. 1.
Figure 5:
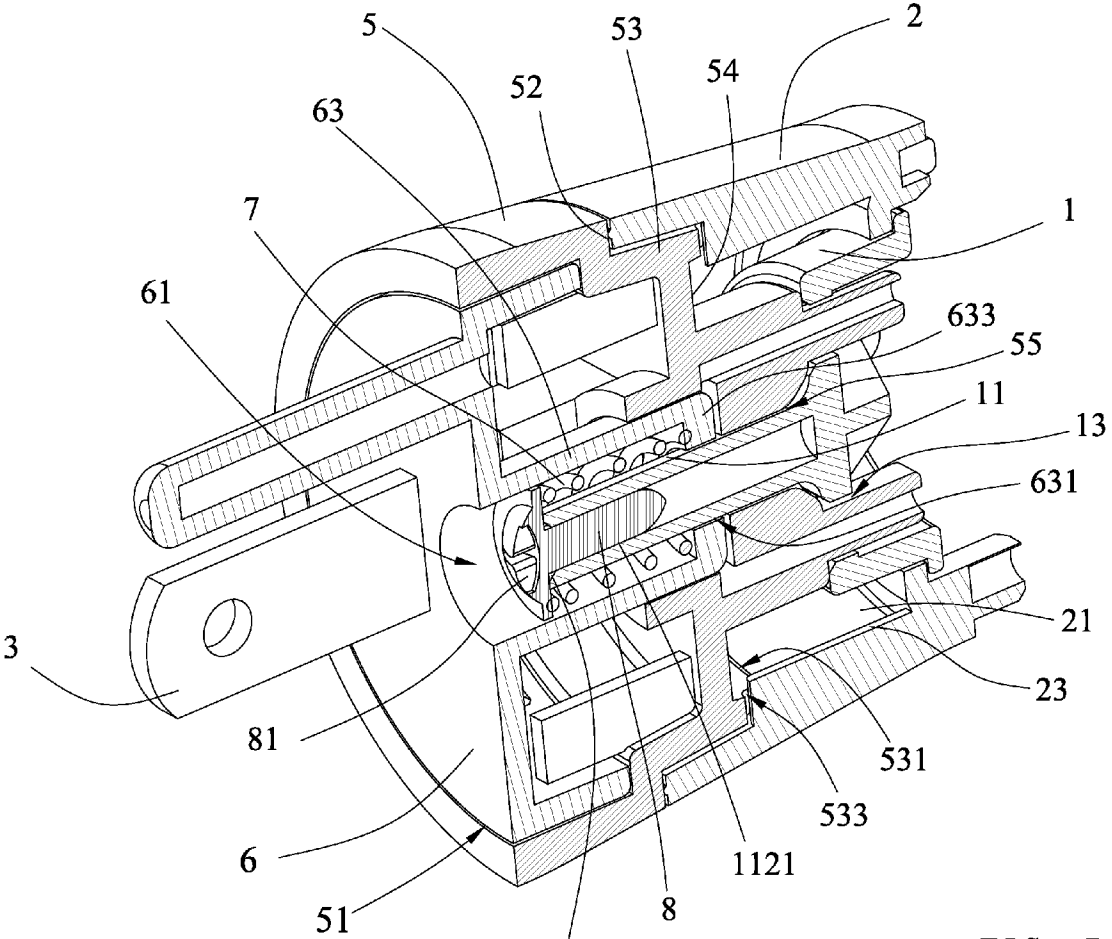
FIG. 5 is a sectional view, in an enlarged scale, taken along line B-B of FIG. 1.

Referring to FIGS. 1-5, the invention provides a rotating electrical plug that has a simple structure and allows adjustment of the installation angle positively and safely to fit different electrical sockets.

The rotating electrical plug comprises a bottom cap 1, a hollow shell 2, a rotary member 5, an electrode holder 6, an elastic member 7, and a fastening device 8.

The bottom cap 1 comprises a shaft 11 perpendicularly extended from one side thereof and terminating in a free end 112, and a plurality of holes 13 spaced around the shaft 11.

The hollow shell 2 comprises at least one locating block 23 located at an inner wall 21 thereof. The aforesaid bottom cap 1 is attached to one side of the hollow shell 2, enabling the shaft 11 to be secured to the inside of the hollow shell 2.

The rotary member 5 comprises an open chamber 51 defined in one side thereof, an stop flange 52 radially extending around the periphery thereof, an annular plug flange 53 perpendicularly and axially extended from one side of the stop flange 52 and terminating in a sliding end edge 531, a plurality of locating notches 533 located on the sliding end edge 531, a bottom wall 54 transversely defined inside the annular plug flange 53, and a first shaft hole 55 and a set of electrode holes 56 defined in the bottom wall 54. The annular plug flange 53 of the rotary member 5 is inserted into the inside of the hollow shell 2 to couple the first shaft hole 55 to the shaft 11 and to stop the stop flange 52 against the hollow shell 2, enabling the locating notches 533 to be respectively movably coupled to (temporarily engaged with) the locating blocks 23.

The electrode holder 6 is an electrically insulative member comprising a center hole 61, a shaft sleeve 63 perpendicularly extended from one side thereof around one end of the center hole 61 and defining therein an axially extending second shaft hole 631 and a transversely extending inside annular flange 633 in the second shaft hole 631, and a set of electrode holes 65 spaced around the center hole 61. The electrode holder 6 is mounted in the open chamber 51 of the rotary member 5, enabling the shaft 11 to be received in the second shaft hole 631 inside the shaft sleeve 63.

The elastic member 7 is a metal member mounted in the shaft sleeve 63 around the shaft 11 and stopped with its one end against the inside annular flange 633 of the shaft sleeve 63.

The fastening device 8 is fastened to the free end 112 of the shaft 11 to secure the opposite end of the elastic member 7 to the shaft 11.

Figure 6:
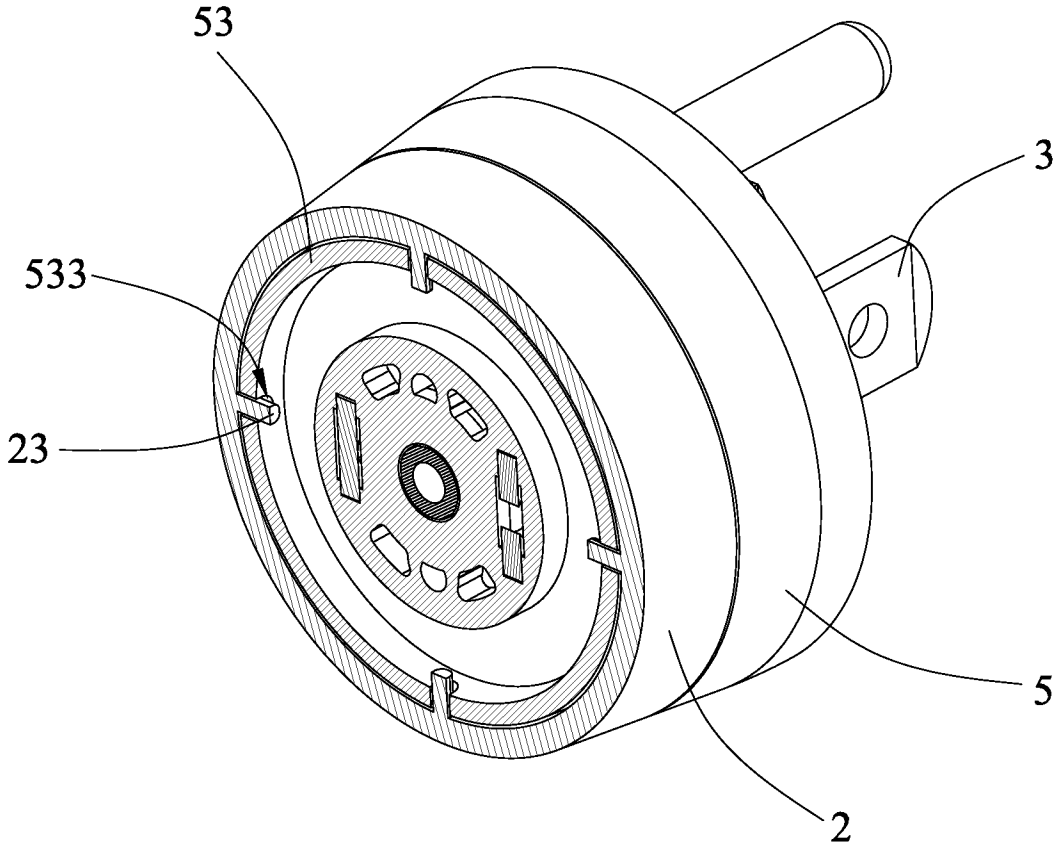
FIG. 6 is a sectional view, in an enlarged scale, taken along line C-C of FIG. 1.

Referring to FIG. 6 and FIGS. 1, 4 and 5 again, during application of the present invention, the user can hold the hollow shell 2 with one hand and pull the rotary member 5 and the electrode holder 6 with the other hand to move the stop flange 52 from the hollow shell 2 and to move the inside annular flange 633 of the shaft sleeve 63 along the shaft 11 against the elastic member 7, disengaging the locating notches 533 from the locating blocks 23 and causing the elastic member 7 to store elastic potential energy and allowing the rotary member 5 to be rotated relative to the hollow shell 2. At this time, the user can rotate the rotary member 5 to bias the bottom cap 1 and the electrode holder 6 relative to the hollow shell 2 through a predetermined angle and then release the hand from the rotary member 5, enabling the rotary member 5 to be pushed back by the stored elastic potential energy of the elastic member 7 to the condition where the sliding end edge 531 of the annular plug flange 53 of the rotary member 5 is stopped against the locating blocks 23. Thereafter, the user can rotate the rotary member 5 and the electrode holder 6 to rub the sliding end edge 531 of the annular plug flange 53 against the locating blocks 23. When rotating the rotary member 5 relative to the hollow shell 2 at this time, the user hand can sense the friction between the sliding end edge 531 of the annular plug flange 53 and the locating blocks 23 and engagement between the respective locating notches 533 and the respective locating blocks 23. After the rotary member 5 is adjusted to the desired angle relative to the hollow shell 2 and the respective locating notches 533 are engaged in the respective locating blocks 23, the stop flange 52 is accurately stopped at the hollow shell 2, and thus the adjustment of the angular position of the rotating electrical plug is done. After the adjustment, the respective locating notches 533 and the respective locating blocks 23 are engaged together, holding the rotating electrical plug positively in the adjusted position.

This design of rotating electrical plug has the characteristics of simple structure and accurate positioning. Further, the user can also hold the rotary member 5 with one hand and pull and rotate the hollow shell 2 conveniently with the other hand, achieving the same effects.

Further, when changing the angular position of the rotating electrical plug, the user can sense the positioning between the hollow shell 2 and the rotary member 5 auditorally and tactilly.

Further, the invention fits different electrical outlets in different directions. By means of sliding friction between the locating notch 533 and sliding end edge 531 of the annular plug flange 53 and the locating block 23, the user's hand can sense the change of the angular position of the electrical plug tactilly and the engagement between the locating notch 533 and the locating block 23. When the locating blocks 23 are engaged into the locating notch 533, a sound will be produced, enabling the user to make sure that the electrical plug has been positively adjusted to the desired angular position. Thus, the rotating electrical plug of the invention eliminates the problem of inaccurate positioning of the prior art designs.

In the aforesaid preferred embodiment of the present invention, the elastic member 7 is a coil spring directly sleeved onto the shaft 11. Alternatively, the elastic member 7 can be made in the form of a spring plate or rubber block to substitute for the coil spring, achieving the same effects.

Further, in the aforesaid preferred embodiment of the present invention, the free end 112 of the shaft 11 defines therein an inner thread 1121; the fastening device 8 can be a screw inserted into the inner thread 1121 in the free end 112 of the shaft 11 with the head (or nut) 81 thereof stopped at one end of the elastic member 7 that is mounted in the shaft sleeve 63 around the shaft 11.

Further, the hollow shell 2 can be configured having only one single locating block 23, and the rotary member 5 can be configured having two or four equiangularly spaced locating notches 533 for selectively receiving the single locating block 23. If only two locating notches 533 are provided, they are spaced from each other at angle of 180-degrees. If four locating notches 533 are provided, they are spaced from one another at angle of 90-degrees, and the rotary member 5 can be selectively changed to 90° angle, 180° angle or 270° angle relative the hollow shell 2.

Further, the hollow shell 2 is configured to provide two locating blocks 23, the rotary member 5 can be configured to provide two or four equiangularly spaced locating notches 533 for selectively receiving the single locating block 23. If only two locating notches 533 are provided, they are spaced from each other at angle of 180-degrees. If four locating notches 533 are provided, they are spaced from one another at angle of 90-degrees, and the rotary member 5 can be selectively changed to 90° angle, 180° angle or 270° angle relative the hollow shell 2.

Further, the hollow shell 2 is configured to provide four locating blocks 23 that are spaced from one another at 90° angle and the rotary member 5 is also configured to provide four locating notches 533 that are spaced from one another at 90° angle, the rotary member 5 can be selectively changed to 90° angle, 180° angle or 270° angle relative the hollow shell 2.

Figure 7:
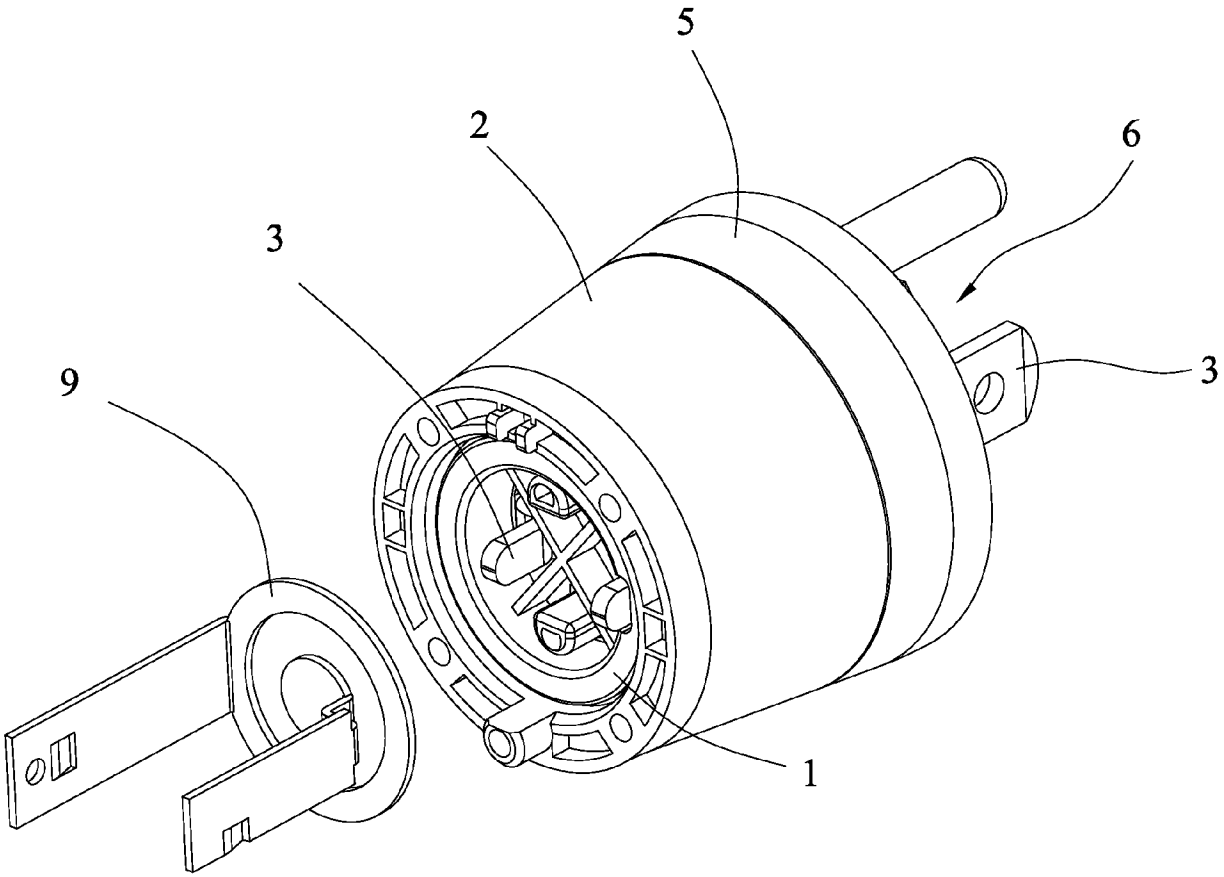
FIG. 7 is an oblique elevation illustrating the relationship between the rotating electrical plug and the mating conducting plate unit.

Referring to FIG. 7, the rotating electrical plug of the present invention further comprises a set of electrode plates 3 respectively mounted in the electrode holes 65 of the electrode holder 6 and respectively inserted through the electrode holes 56 of the rotary member 5 and the holes 13 of the bottom cap 1 for rotatably and electrically coupling to an external conducting plate unit 9 (including a positive pole conducting plate and a negative pole conducting plate).

Further, the aforesaid conducting plate unit 9 can be a component part of the rotating electrical plug in accordance with the present invention. In this case, the conducting plate unit 9 can be affixed to the hollow shell 2 with the positive pole conducting plate and negative pole conducting plate thereof constantly kept in contact with the respective electrode plates 3, allowing rotation of the electrode holder 6 with the rotary member 5 relative to the hollow shell 2.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A rotating electrical plug, comprising:

a bottom cap comprising a shaft perpendicularly extended from one side thereof and terminating in a free end;

a hollow shell connected to said bottom cap to surround said shaft, said hollow shell comprising at least one locating block located at an inner wall thereof;

a rotary member comprising an open chamber defined in one side thereof, an stop flange radially extending around the periphery thereof, an annular plug flange perpendicularly and axially extended from one side of said stop flange and terminating in a sliding end edge, a plurality of locating notches located on said sliding end edge, a bottom wall transversely defined inside said annular plug flange and a first shaft hole defined in said bottom wall, said annular plug flange of said rotary member being inserted into the inside of said hollow shell to couple said first shaft hole to said shaft and to stop said stop flange against said hollow shell for enabling said locating notches to be respectively movably coupled to said locating blocks;

an electrically insulative electrode holder comprising a center hole, and a shaft sleeve perpendicularly extended from one side thereof around one end of said center hole and defining therein an axially extending second shaft hole and a transversely extending inside annular flange in said second shaft hole;

said electric holder mounted in said open chamber of said rotary member for enabling said shaft to be received in said second shaft hole inside said shaft sleeve;

a metal elastic member mounted in said shaft sleeve around said shaft and stopped with one end thereof against said inside annular flange of said shaft sleeve; and a fastening device fastened to said free end of said shaft to secure an opposite end of said elastic member to said shaft; and a set of electrode plates respectively fixedly mounted in said electrode holder and respectively inserted through said rotary member and said bottom cap for rotatably and electrically coupling to an external conducting plate unit.

2. The rotating electrical plug as claimed in claim 1, wherein said elastic member is a coil spring.

3. The rotating electrical plug as claimed in claim 2, wherein said bottom cap comprises an inner thread disposed in said free end of said shaft; said fastening device comprises a screw threaded into said inner thread of said bottom cap, and a nut threaded onto said screw and stopped against said opposite end of said elastic member.

4. The rotating electrical plug as claimed in claim 2, wherein the number of said locating notches of said rotary member is 2 or 4.

5. The rotating electrical plug as claimed in claim 2, wherein the number of said locating notches of said rotary member is 4; the number of said at least one locating block of said hollow shell is 4.

6. The rotating electrical plug as claimed in claim 1, wherein said elastic member is selected from the group of spring plate and rubber block.

7. The rotating electrical plug as claimed in claim 6, wherein the number of said locating notches of said rotary member is 2; the number of said at least one locating block of said hollow shell is 2 or 4.

8. The rotating electrical plug as claimed in claim 1, wherein said bottom cap comprises an inner thread disposed in said free end of said shaft; said fastening device comprises a screw threaded into said inner thread of said bottom cap, and a nut threaded onto said screw and stopped against said opposite end of said elastic member.

9. The rotating electrical plug as claimed in claim 1, wherein the number of said locating notches of said rotary member is 2 or 4.

10. The rotating electrical plug as claimed in claim 1, wherein the number of said locating notches of said rotary member is 2; the number of said at least one locating block of said hollow shell is 2 or 4.

11. The rotating electrical plug as claimed in claim 1, wherein the number of said locating notches of said rotary member is 4; the number of said at least one locating block of said hollow shell is 4.

12. The rotating electrical plug as claimed in claim 1, said conducting plate unit fixedly mounted in said hollow shall adjacent to said bottom cap for conducting said electrode plates electrically.

* * * * *